United States Patent [19]

Couwenberg

[11] Patent Number: 4,728,091

[45] Date of Patent: Mar. 1, 1988

[54] SHEET REMOVAL DEVICE

[75] Inventor: Franciscus A. C. M. Couwenberg, Zuringbeek 10, Netherlands

[73] Assignee: Oce-Nederland B.V., Venlo, Netherlands

[21] Appl. No.: 892,343

[22] Filed: Aug. 1, 1986

[30] Foreign Application Priority Data

Aug. 5, 1985 [NL] Netherlands ..... 8502185

[51] Int. Cl.[4] ..... B65H 3/14

[52] U.S. Cl. ..... 271/97; 271/99; 271/132

[58] Field of Search ..... 271/3.1, 97, 98, 99, 271/132, 102; 294/64.2, 64.3

[56] References Cited

U.S. PATENT DOCUMENTS

| | | | |
|---|---|---|---|
| 3,158,367 | 11/1964 | Tarbuck | 271/97 |
| 3,385,593 | 5/1968 | Snellman | 271/98 X |
| 4,324,394 | 4/1982 | Mitzel | 271/98 X |
| 4,627,606 | 12/1986 | Moore | 271/98 |

FOREIGN PATENT DOCUMENTS

| | | | |
|---|---|---|---|
| 435327 | 10/1967 | Switzerland | 271/99 |

*Primary Examiner*—Richard A. Schacher

*Attorney, Agent, or Firm*—Reed Smith Shaw & McClay

[57] ABSTRACT

A device is provided for the removal of the lowermost sheet from a stack of sheets in a tray wherein part of the tray consists of a removal element having a top surface with a first set of grooves through which an air stream can be blown to produce a static partial vacuum and a second set of grooves outside the air stream, each connected to at least one of the grooves in the first set. As a result of the air stream in the first set of grooves, the lowermose sheet is drawn against the top surface of the removal element and air is sucked out of the second set of grooves, the sheet thereby being more forcibly sucked against the removal element. By moving the removal element away from the stack, the lowermost sheet is removed from the stack using only a small amount of air in the air stream.

6 Claims, 7 Drawing Figures

SHEET REMOVAL DEVICE

FIELD OF THE INVENTION

This invention relates to a device for the removal of a sheet from a stack of sheets. It is particularly useful in copying machines.

BACKGROUND OF THE INVENTION

Some devices for removing a sheet from a stack of sheets utilize a partial vacuum created by suction while others utilize a partial vacuum created by a blown air stream. Swiss Pat. No. 435,327; French Pat. No. 2185229 and German Patent Application No. 3220237 are examples of the former, while European Patent Application No. 0032765 is an example of the latter.

The device described in European Patent Application No. 0032765 contains a removal element having several separate recesses, which can be used to feed sheets one by one from a stack to a printing or copying device. A disadvantage of this device is that a relatively large partial vacuum is necessary in the separate recesses to always and reliably separate sheets of different types from the stack. To achieve the relatively large partial vacuum, large quantities of air have to be blown at high speeds through each separate recess. The air pump or compressor necessary for this purpose must have a large capacity and, therefore, will be relatively expensive. Additionally, the air blown at high speeds will cause considerable noise, which can be troublesome and unacceptable in the workplace. It would be desirable, therefore, to design a sheet removal device utilizing a blown air stream such that very reliable operation s achieved with a considerably smaller displacement of air.

SUMMARY OF THE INVENTION

Generally, the present invention relates to a device for the removal of a sheet from a stack of sheets in a holder such as a tray comprising: a removal element forming part of the tray with a surface thereof facing the stack of sheets which surface is provided with at least one first recess and at least one second recess which is connected to the first recess near a blow opening in a side of the first recess; a means for blowing air through the blow opening and the first recess such that the air stream from the blow opening is not blown into the second recess thereby producing a static partial vacuum in both recesses such that the sheet to be removed is drawn against the surface of the removal element; and a drive means for displacing the removal element to remove the sheet firmly held thereon from the stack.

In a device constructed according to the present invention, if a sheet is drawn by the partial vacuum in the first recess towards the surface while covering the second recess completely or partially, air will be sucked out of the second recess via the connection to the first recess as a result of the jet pump action of the air emerging from the blow opening. In the second recess, virtually the same partial vacuum will be produced as in the first recess. Hence, the sheet to be separated is not only drawn firmly against the surface parts in which the first recess is formed, but also against the surface parts in which the second recess is formed.

In comparison with other devices, a much larger surface is thus obtained against which the sheet to be separated is drawn. To achieve the same separation force in the present invention, the partial vacuum and consequently the amount of air blown out or the speed thereof may be considerably smaller (for example, a half or a third) than in devices with only recesses through which air can be blown. This desirable effect only occurs if the second recess is connected to the first recess in a manner such that the air from the blow opening is not blown into the second recess.

Other characteristics and advantages of the present invention will become clear from the detailed description of the preferred embodiments and with reference to the accompanying drawings.

DESCRIPTION OF THE PREFERRED EMBODIMENTS

Figure 1:
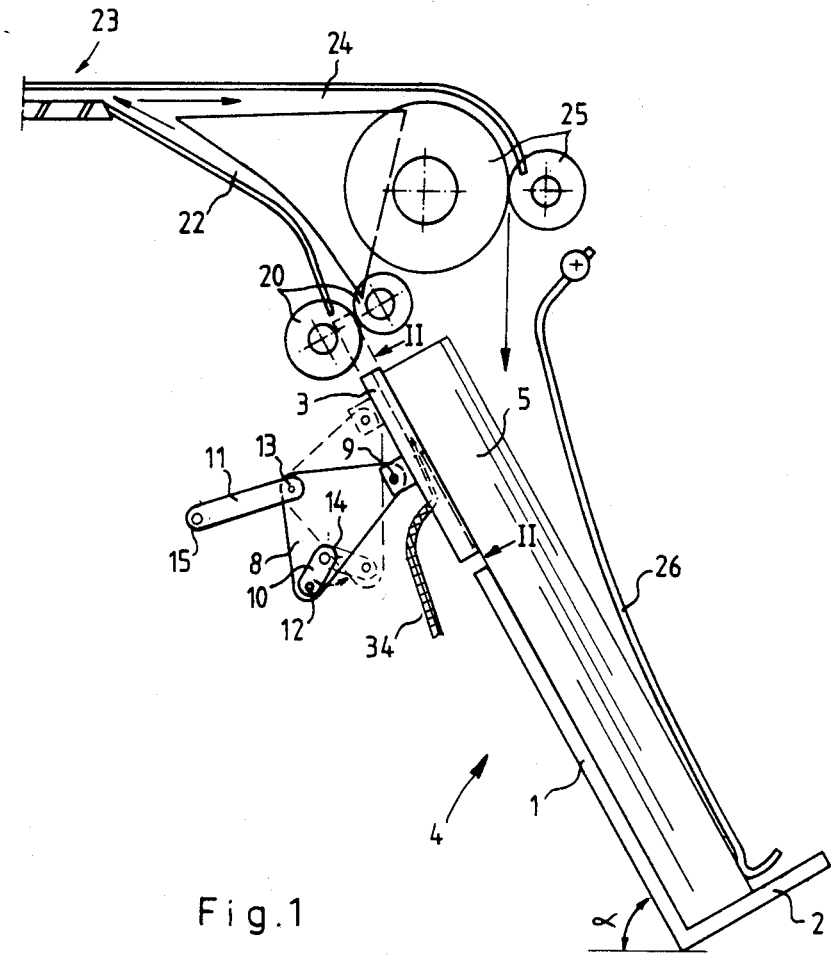
FIG. 1 shows a side view of a device according to the present invention.

The device shown in FIG. 1 contains a tray 4 having a flat baseplate 1 which is arranged at an angle $\alpha$ of 60° to the horizontal. At the lowermost edge of the baseplate, a wall plate 2 is attached which extends in a direction perpendicular to baseplate 1. Above the uppermost edge of baseplate 1, a ruler-shaped removal element 3 is arranged in line with baseplate 1. A stack of sheets 5 can be placed in tray 4 with the lowermost sheet of stack 5 resting partly on baseplate 1 and partly on the upper surface of removal element 3. Removal element 3 extends transversely below entire stack 5 and has, near the ends, specially shaped parts 6 and 7 which will be described later with reference to FIGS. 2 and 3.

On the underside of removal element 3, a triangular plate 8 is arranged which extends in a plane perpendicular to removal element 3. Plate 8 is pivotably linked in an angular section to removal element 3 by means of a pin 9 which extends parallel to the bottom surface of tray 4. In the other angular sections of plate 8, an arm 10 and an arm 11, respectively, are pivotably linked at one end to plate 8 by means of pins 12 and 13, respectively. The other ends of arms 10 and 11 are able to pivot respectively about pins 14 and 15 which are permanently linked to a frame (not shown) of the device. Arm 10 can be turned to and fro about pin 14 between a starting position shown by full lines and a working position shown by broken lines in FIG. 1 by a drive means (not shown) such as a motor. The movement mechanism formed by arms 10 and 11 and plate 8 converts the turning of arm 10 into a movement of removal element 3 in its own plane between the starting position of removal element 3 shown in FIG. 1 by full lines and the uppermost position shown by broken lines.

Above tray 4, two pairs of conveyor rollers 20 are arranged next to each other (in FIG. 1 behind each other) each forming a nip which is situated in line with the bottom surface of tray 4 and is so close to removal element 3 that the latter, in the uppermost position, can extend past the nip. For this purpose, removal element 3 is provided with recesses 21, shown in FIG. 2, into which the lowermost rollers of conveyor rollers 20 fit. The pairs of conveyor rollers 20 feed a sheet entrained by or held on removal element 3 via conveyor path 22 to a sheet processing device 23 (not shown), for example the exposure platen of a copying device. A processed sheet can be fed back from there via conveyor path 24 by the pairs of conveyor rollers 25 to tray 4 where it is pressed by the end of a resilient strip 26 slightly against baseplate 1 or against the sheets of stack 5 lying thereon.

Figure 3:
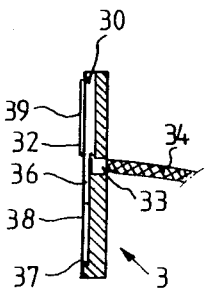
FIG. 3 shows a section of the removal element taken along line III—III in FIG. 2.
Figure 2:
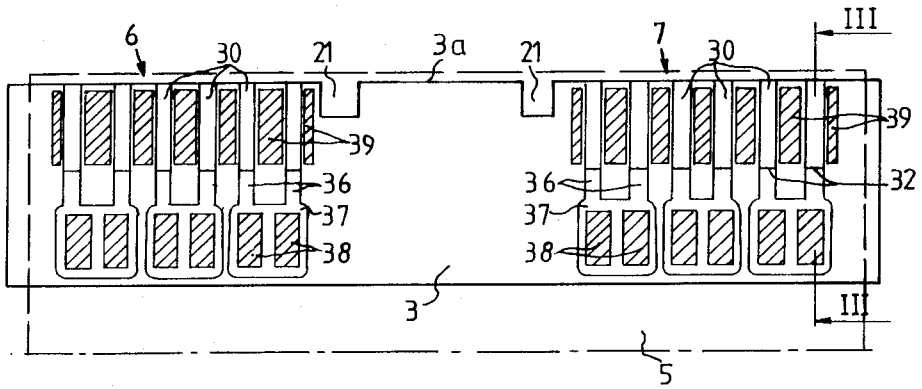
FIG. 2 shows a view of the removal element taken along line II—II in FIG. 1.

Removal element 3 shown in detail in FIGS. 2 and 3 has a length which approximately corresponds to that dimension of a sheet perpendicular to the sheet removal direction. Each of the parts 6 and 7 of removal element 3 is provided with six first recesses in the form of grooves 30 located, within a short distance, next to each other, which are formed in the flat topside of removal element 3 and which extend parallel to the short side of removal element 3 from the middle thereof to an edge 3*a*. Each groove 30 has a length of 20 mm, a width of 5 mm and a depth of 2 mm. The end of each groove 30 which is in the middle of removal element 3 is provided with a round opening 32 of 0.4 mm diameter, which opening 32 borders upon the bottom of the respective groove 30 and communicates with a chamber 33 formed in removal element 3 and common for the six grooves. Chamber 33 is connected via a flexible hose 34 to an air pump (not shown) which via openings 32 blows air through each groove 30. This air is discharged at edge 3*a* of removal element 3.

In line with each groove 30, on the side where the opening 32 is located, a recess is disposed in the upper surface of removal element 3 in the form of a groove 36 which is equally as wide as groove 30, but only 1 mm deep. Each groove 36 is connected to its corresponding groove 30. Two grooves 36 situated next to each other form a pair which debouch into an approximately square recess 37 having a size of approximatey 400 $mm^2$ which, like grooves 36, is 1 mm deep. The pair of grooves 36 situated next to each other together with the associated recess 37 form a second recess in removal element 3.

In each of the recesses 37, there are disposed next to each other two strips 38 of frictional material, such as, for example silicone rubber, each having an area of approximately 160 $mm^2$. The surface of these strips is situated 0.1 mm below the upper surface of removal element 3. On the upper surface of removal element 3, strips of frictional material 39 are disposed between grooves 30. The upper surface of strips 39 is situated 0.1 mm above the upper surface of removal element 3.

The operation of removal element 3 as shown in FIGS. 2 and 3 and as used in the device shown in FIG. 1 will now be described. To separate the lowermost sheet of a stack of sheets 5 placed in tray 4, air with an effective pressure of 0.5 Bar is supplied to chamber 33 of removal element 3 and flows out via openings 32. At continuous operation, the consumption of air by removal element 3 is approximately 27 liters at 1 Bar and 20° C. As a result of the air flow in recesses 30, a partial vacuum is produced therein causing the lowermost sheet of stack 5, situated on removal element 3, to be drawn forcibly against the top surface of removal element 3, in particular against strips 39, because of the speed effect of the air jets. As a result of the air flow in lengthy recesses 30, air is also sucked out of recesses 36 and 37 as a result of which the same partial vacuum is produced therein as in recesses 30 causing the sheet to be sucked forcibly against strips 38 (jet jump effect of the air jets).

After the lowermost sheet of stack 5 has been sucked against removal element 3, arm 10 is turned once to and fro. Removal element 3 moves as a result virtually along a straight line from the starting position shown in full lines in FIG. 1 to the working position shown in broken lines, and back. During this movement of removal element 3, the lowermost sheet of stack 5 is held firmly on removal element 3 and is drawn away from stack 5 so that the front edge of the sheet arrives in the nip between rollers 20. When the sheet has been gripped by rollers 20, the supply of air to removal element 3 is interrupted and the sheet is drawn away completely from beneath stack 5 by rollers 20. During this drawing away, removal element 3 moves back to the starting position. A slight resistance is experienced as a result of friction strips 38 which are disposed in a recessed position.

From tests made on this device, it appears that for the separation of a sheet from a stack which comprises approximately 70 sheets of A4 size, each having a weight of 80 $g/m^2$, an effective pressure of the air supplied of 0.2 Bar may be sufficient. If the sheets have a weight of 170 $g/m^2$, then air with an effective pressure of 0.5 Bar is necessary. Under these circumstances, it was possible to separate A4 sheets with a speed of 0.5 m/s.

Figure 5:
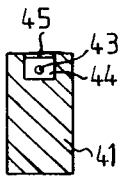
FIG. 5 shows a section taken along line IV—IV of the removal element shown in FIG. 4.
Figure 4:
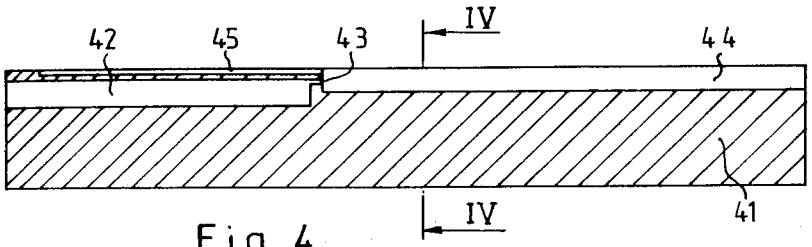
FIG. 4 shows a section of another embodiment of the removal element according to the present invention, similar to the view shown in FIG. 3.

FIGS. 4 and 5 show a trial unit of another removal element according to the present invention. The removal element consists of a block 41 in which a chamber 42 is formed which can be connected to an air pump (not shown). Via a round discharge opening 43, chamber 42 is connected to a lengthy first recess 44 in the upper surface of block 41, which recess extends to the edge of the block. A second recess 45 in the upper surface of block 41 is situated in line with first recess 44 as shown in FIGS. 4 and 5.

For test blocks of the type described above, but having differing dimensions, the partial vacuum reached in the first recesses 44 and second recesses 45 have been measured as a function of the dimensions of the recesses by means of an air pressure recorder. It appears that for a width of recesses 44 and 45 of 5 mm and a discharge opening 43 of 0.4 mm, a length of recess 44 of 20 mm is amply sufficient to obtain the necessary partial vacuum. It also appears that the partial vacuum in second recess 45 reaches a value which is virtually equal to the partial vacuum which is reached in first recess 44.

Figure 6:
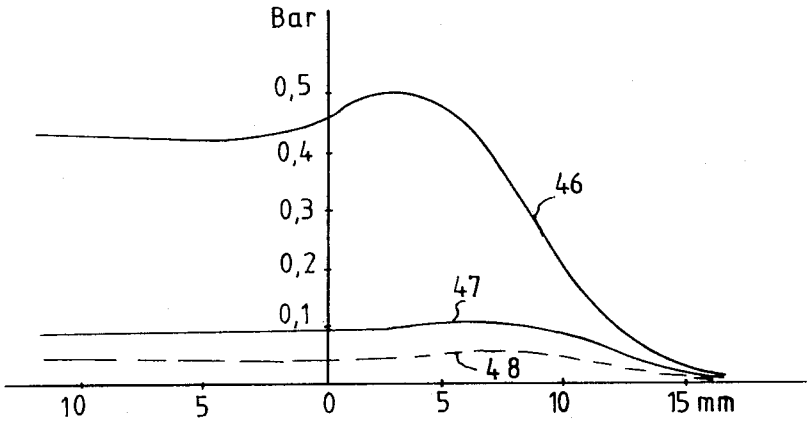
FIG. 6 is a graph of the static partial vacuum as a function of the pressure of the blow air supplied, as measured on the removal element shown in FIGS. 4 and 5.

The partial vacuum which is reached at various points in the recesses in the case of a test block in which the depth of recess 44 is 4 mm and that of the recess 45 is 1 mm is shown in FIG. 6. The y-axis shows the partial vacuum in terms of pressure. The right-hand portion of the x-axis represents positions in first recess 44 moving away from discharge opening 43. The left-hand portion of the x-axis represents positions in second recess 45 as one moves farther from the location of discharge opening 43. Line 46 in FIG. 6 represents the partial vacuum in the recesses for an effective pressure of 6 Bar in chamber 42. Line 47 represents the partial vacuum in the recesses for an effective pressure in chamber 42 of 1 Bar. The partial vacuum in the recesses at an effective pressure of 0.5 Bar in chamber 42 is shown by dotted line 48 which is obtained by extrapolation of lines 46 and 47.

Figure 7:
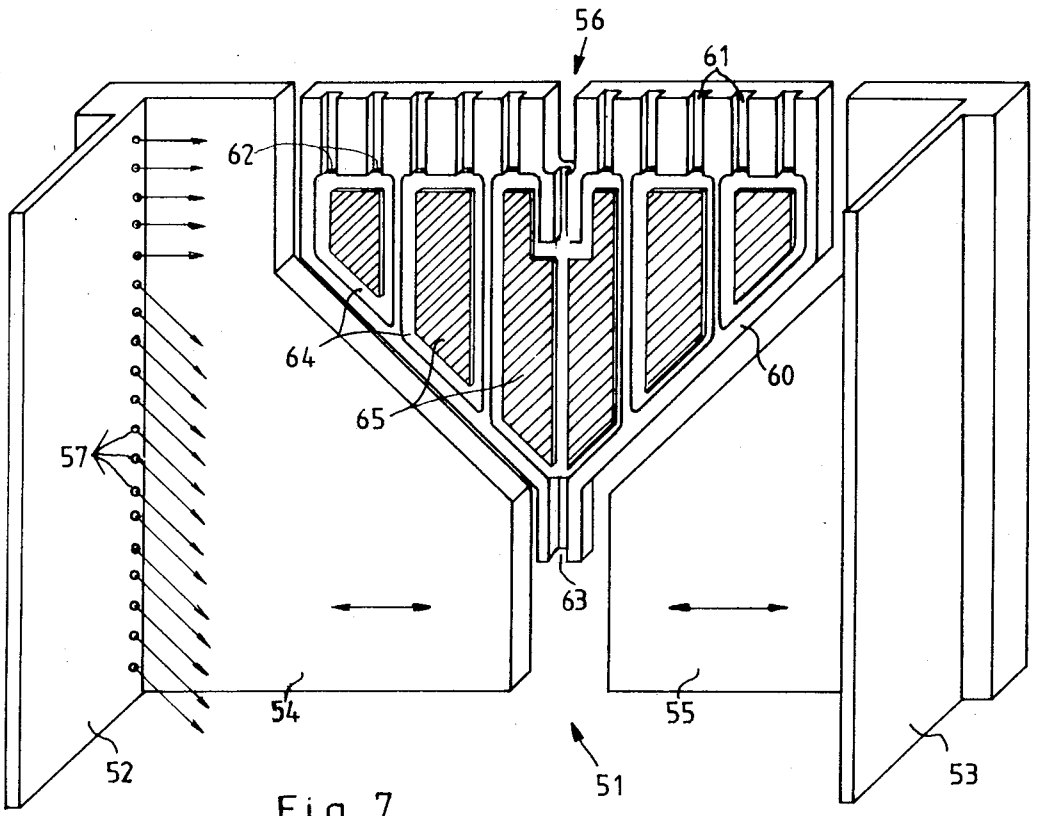
FIG. 7 shows a view of another embodiment of a removal element according to the present invention, similar to the view shown in FIG. 2.

FIG. 7 shows a tray 51 for receiving a stack of sheets, which comprises two parallel sideplates 52 and 53 which are connected to baseplates 54 and 55, respectively. Baseplates 54 and 55, together with a removal element 56, form the base of tray 51. Sideplates 52 and 53 are displaceable with respect to each other in order to enclose the stack between them with a play of 1 to 1.5 mm.

Removal element 56 has an upper surface 60 which is smooth in order to facilitate the insertion of sheets. In upper surface 60, eleven lengthy first recesses 61 are disposed at regular distances from each other through which air is blown from openings 62. The air to openings 62 is fed from a central supply channel 63 via a channel system which is not shown. Five second recesses 64 are also located in upper surface 60 behind and connected to first recesses 61.

In dead-end second recesses 64, strips of silicone rubber 65 are disposed as islands and are situated 0.15 mm below upper surface 60 of removal element 56. In sideplates 52 and 53, close to the junction with baseplates 54 and 55, respectively, twenty perforations 57 are formed at regular distances, each having a diameter of 0.4 mm. If air with an effective pressure of 1 Bar is blown through openings 57 into tray 51, then an effective pressure of 0.1 Bar supplied to removal element 56 is sufficient to separate a stack of 50 A4 sheets weighing 65–120 g/m$^2$ without malfunction. Tray 51 is particularly suitable for the separation of sheets of 170 g/m$^2$ if at least via the rearmost fifteen openings 57 air is blown between the sheets at an angle of 135° to the removal direction. For this purpose, the respective openings are formed by holes drilled obliquely in sideplates 52 and 53.

The shape of removal element 56, being broadly divergent in the removal direction, is beneficial because it provides space for a relatively large number of lengthy first recesses 61 through which air can be blown (requires a wide removal element), it provides for a large surface with dead-end second recesses out of which air can be sucked (requires a removal element having a large surface) and it provides for a baseplate along which sufficient air from the sideplates can be blown into the tray (requires a narrow removal element).

In the embodiments discussed above, the air fed through the first recesses does not need to be removed since the recesses extend to the edge of the removal element. Of course, it is not necessary for these recesses to extend to the edge. In alternative embodiments, it is also possible to provide recesses which do not continue to an edge. In that case, removal paths, for example channels through the materal of the removal element, have to be provided to remove the air.

While presently preferred embodiments of the invention have been described in particularity, the invention may be otherwise embodied within the scope of the appended claims. For example, the sheet removal device of the present invention may also be used to remove sheets from the top of a stack of sheets and not only the bottom as shown in some of the preferred embodiments.

What is claimed is:

1. A device for the removal of a sheet from a stack of sheets in a holder comprising:

a removal element with a surface thereof facing the stack of sheets which surface is provided with at least a first recess and at least a second recess which is connected to the first recess near a blow opening in a side of the first recess;

a means for blowing air through the blow opening and through the first recess such that the air stream from the blow opening is not blown into the second recess thereby producing a partial vacuum in both recesses such that the sheet to be removed is drawn against the surface of the removal element; and a drive means for displacing the removal element to remove the sheet firmly held thereon from the stack.

2. A device as described in claim 1 wherein the second recess comprises at least one surface part which is rough and at least one surface part which is recessed with respect to the rough surface part.

3. A device as described in claim 2 wherein the rough surface part is surrounded by the recessed surface part.

4. A device as described in claim 3 wherein the removal element when viewed in the removal direction diverges in a V-shape and the holder has at least one sidewall containing a plurality of openings through which air can be blown against the side edge of the stack but not in the direction to sheet removal.

5. A device as described in claim 1 wherein the removal element when viewed in the removal direction diverges in a V-shape and the holder has at least one sidewall containing a plurality of openings through which air can be blown against the side edge of the stack but not in the direction to sheet removal.

6. A device as described in claim 2 wherein the removal element when viewed in the removal direction diverges in a V-shape and the holder has at least one sidewall containing a plurality of openings through which air can be blown against the side edge of the stack but not in the direction to sheet removal.

* * * * *